US008347441B2

(12) United States Patent
Thomson

(10) Patent No.: US 8,347,441 B2
(45) Date of Patent: Jan. 8, 2013

(54) LOAD BEARING CONSTRUCTION AND METHOD FOR INSTALLATION

(76) Inventor: James Thomson, Crans Montana (CH)

( * ) Notice: Subject to any disclaimer, the term of this patent is extended or adjusted under 35 U.S.C. 154(b) by 716 days.

(21) Appl. No.: 11/482,224

(22) Filed: Jul. 7, 2006

(65) Prior Publication Data

US 2007/0006401 A1 Jan. 11, 2007

(30) Foreign Application Priority Data

Jul. 9, 2005 (GB) ..... 0514142.9

(51) Int. Cl.
*E01D 19/12* (2006.01)

(52) U.S. Cl. ..... 14/73

(58) Field of Classification Search ..... 14/73
See application file for complete search history.

(56) References Cited

U.S. PATENT DOCUMENTS 2,184,137 A * 12/1939 Brewer ..... 52/223.7
3,125,009 A * 3/1964 Eberl ..... 404/71
3,882,564 A * 5/1975 Muller ..... 14/77.3
4,625,354 A * 12/1986 Richard ..... 14/73
4,918,777 A * 4/1990 Ashley ..... 14/73
5,072,474 A * 12/1991 Dilger et al. ..... 14/77.1
5,511,266 A * 4/1996 Dinis ..... 14/2.5
5,940,916 A * 8/1999 Sauvageot ..... 14/2.5
5,987,680 A * 11/1999 Sakaya ..... 14/73
6,170,105 B1 * 1/2001 Doyle et al. ..... 14/73
6,381,793 B2 * 5/2002 Doyle et al. ..... 14/73
6,591,567 B2 * 7/2003 Hota et al. ..... 52/578
6,795,992 B2 * 9/2004 Markelz ..... 14/77.1
7,131,161 B2 * 11/2006 Lee ..... 14/73
7,418,804 B2 * 9/2008 Tokuno et al. ..... 52/223.7
7,546,656 B2 * 6/2009 Kim et al. ..... 14/77.1

* cited by examiner

*Primary Examiner* — Gary S Hartmann
(74) *Attorney, Agent, or Firm* — GableGotwals

(57) ABSTRACT

The invention relates to a load bearing construction such as a bridge in which there is provided a deck structure which is supported by and spans at least two support portions. The invention provides for the advancement of the deck structure along said support portions and in advance of said structure excavation can occur to create the space into which the deck structure is to be advanced.

16 Claims, 3 Drawing Sheets

LOAD BEARING CONSTRUCTION AND METHOD FOR INSTALLATION

FIELD OF THE INVENTION

The invention to which this application relates is the provision of a deck structure for use as part of a load bearing construction such as a bridge and also a method for the installation of the same.

BACKGROUND OF THE INVENTION

The provision of deck structures is now described with reference to a bridge although it should be appreciated that the same apparatus and method may be used to effect with respect to other load bearing structures such as underpasses, underground stations roofs or the like and therefore the description relating to use for bridges should be interpreted in a non-limiting manner.

There is an increasing demand to be able to provide new facilities and structures without affecting existing surface facilities such as rail tracks, roads or the like. Until recently the construction of a bridge would have required construction to be done from the surface using conventional construction techniques and involving considerable disruption and risk to the surface facility, and/or it may be necessary to make expensive temporary diversions of the surface facility to allow the structure to be constructed.

Alternatively the bridge can be constructed more or less complete at a separate location and then slid in to position at a relatively quiet period of use of the existing road or rail services. However, this requires installation in advance of foundations in the form of slide paths, the closure of the rail or road, complete removal of materials and subsequent reinstatement.

Other techniques for forming a deck to allow a new facility to be formed underneath include the jacking of a concrete box structure into position. However these box structures tend to be very large and so a large site is required to allow the structures to be formed adjacent to the bridge which can be expensive. Furthermore the size of these box structures means that large scale excavation needs to be performed to allow the cavities of a required size to be formed to receive the box structures and the jacking forces needed to move large boxes are very great.

It is also known to create advance support structures so as to form a canopy of tubes which act as a partial support structure but these are not capable of supporting the facility loads without provision of internal support arches as excavation is undertaken inside the canopy.

However none of the prior art methods and apparatus allow the decking structure to be formed in an efficient manner.

BRIEF SUMMARY OF THE INVENTION

The aim of the present invention is to provide apparatus and a method for the provision of a load bearing construction including a deck structure, while minimising disruption to a facility which passes over the Construction while the same is being formed.

In a first aspect of the invention there is provided a load bearing construction including a deck structure, said structure provided to span first and second supports, wherein said deck structure is formed from one or more precast slab or beam units which are slidingly advanced into position.

Typically the slabs or beam units are formed from concrete.

In one embodiment said leading edge of said deck structure includes a shielded area within which excavation works can be performed to form a space into which the structure can be advanced, said shielded area in communication with externally of the construction via one or more passages formed in the deck structure. The shield is preferably compartmentalised to assist in controlling the face excavation.

In one embodiment a metal shield is provided.

In one embodiment the deck structure units are constructed with access voids to allow passage to and from the leading face of the deck structure for men, spoil removal, services or the like and it is preferably possible as work proceeds to excavate underneath the deck structure soffit during the installation where additional access is needed.

In one embodiment the supports are in the form of a series of units which act as abutments and piers. Typically, the supports are formed prior to advancement of the deck structure into position, said supports formed to an appropriate height to receive the deck structure. In one embodiment the supports are formed by the jacking of foundation boxes, followed by the jacking of wall units along the foundation units to a height appropriate for the receipt underside of the deck structure.

In one embodiment the deck structure includes one slab unit formed to the appropriate dimensions prior to jacking into position. In an alternative embodiment a series of units are used in combination, said units successively advanced into position.

In one embodiment the depth of the units depend on the size of the span between the bridge supports but may be no less than 1.5 meters and is preferably in the range of 2 meters.

The width of the decking structure is dependent upon the particular use of the construction, for example, the width of the structure for a road bridge will be greater than the width of the structure for a single track rail bridge.

In one embodiment there is provided a fixed and sliding bearing between the deck structure and supports to allow the slab to take up the lateral movements arising from thermal or other causes. Suitable bearings are constructed in the top of the upper wall units of the supports prior to installing the deck. These bearings in one embodiment are revealed by removal of cover plates on the top of the wall unit from inside the shield as the deck structure is jacked into position.

In a further aspect of the invention there is provided a load bearing construction said construction having at least first and second supports spanned by a deck structure, said deck structure formed from one or more slab or beam units and the supports formed from foundation units and wall units, to support the deck structure and wherein the deck structure is advanced into position on said supports from a location adjacent the construction.

In a further aspect of the invention there is provided a method for the formation of a load bearing construction including a deck structure between at least first and second supports, said method including the steps of forming at least part of the deck structure from one or a series of slab or beam units, forming at least first and second spaced supports, wherein the deck structure is advanced into a space defined above the supports excavating as required at the leading edge of the deck structure to form the space and advancing the deck structure into the space formed until the deck structure is in the required position on the supports.

Preferably the method includes the initial steps of forming the bridge supports by jacking into position foundation units and jacking into place thereon wall units to a height required to receive the deck structure thereon.

In one embodiment the method involves the step of moving a deck structure formed from a single precast concrete slab. In an alternative embodiment the deck structure is formed from a series of beams or slabs which are successively advanced as the decking structure is moved forward.

The method involves the step of forming, at the leading edge of the deck structure, a shielded area, said shielded area allowing excavation works to be performed to ensure that the required space is formed to allow the deck structure to be advanced into the space formed by the excavation works.

In one embodiment, the deck structure is advanced into position in a space and when in position the upper surface will be required to be load bearing, i.e. to support facilities such as roads or rail over which traffic or trains pass. During the installation procedure, if the facility is already present above the space, temporary load bearing structures are used to support the upper surface until the deck structure has been advanced into position.

Typically, all of the decking structure is load bearing and is capable of carrying dead weight (of soil) and live (Traffic) loads. Temporary supports can be provided for the track to allow the live loads to be carried and distributed.

Typically once the deck structure is in position, any further excavation works and/or the formation of a road surface or rail track can be undertaken.

In one embodiment the slabs or beam units which make up the decking structure include one or more channels formed therethrough to allow any of access for persons, equipment and/or removal of excavated material from the shielded area.

In one embodiment as the deck is jacked forward, lids on the top faces of the supports are removed to expose a slide channel along which the beams can be slid in a guided manner into position. These areas can also act as a permanent bearing.

In one embodiment the friction between the soil and the top of the deck can be reduced to low values by the use of tried and tested methods of drag sheets or drag ropes. Typically the jacking loads at all stages of installation are relatively small as the individual size of a plurality of jacked structure units offers only a small frictional surface In a further aspect of the invention there is provided a deck or roof on top of a support structure, said deck or roof moved into position by horizontally jacking one or more slab or beam units which are cast in-situ or individually.

In one embodiment the invention is of particular use in relatively shallow applications such as road underpasses where it is important not to disrupt surface traffic or surface structures.

In relatively deep underground constructions the invention is also of advantage as, because of the depth, it is more economic to install the structure using horizontal jacking methods to create the structure envelope ahead of the excavation of the earth.

In a further aspect of the invention there is provided a deck structure located on at least two support structures, said deck structure moved into position by horizontally jacking one or more beams which span between said support structures and are supported thereby to form a load bearing deck structure.

BRIEF DESCRIPTION OF THE DRAWINGS

Specific embodiments of the invention are now described with reference to the accompanying drawings; wherein.

DETAILED DESCRIPTION OF THE PREFERRED EMBODIMENT(S)

For explaining the present invention in detail it is to be understood that the invention is not limited in its application to the details of the construction and arrangement of the parts illustrated in the accompanying drawings. The invention is capable of other embodiments and of being practiced or carried out in a variety of ways. It is to be understood that the phraseology and terminology employed herein are for the purpose of description and not of limitation.

Figure 1:
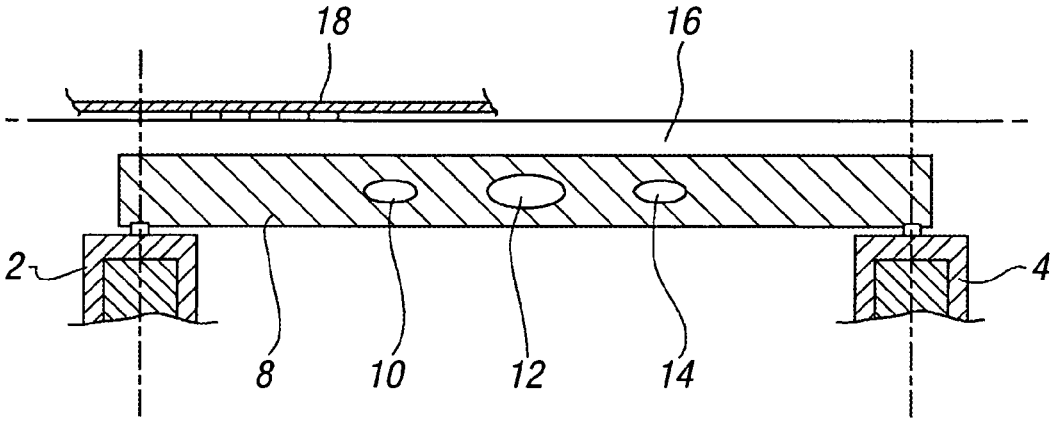
FIG. 1 illustrates an elevation of part of a load bearing construction formed in accordance with the invention in one embodiment.

Referring firstly to FIG. 1 there is illustrated the top part of a load bearing construction in the form of a bridge formed in accordance with the invention. The bridge includes first and second bridge supports 2,4 the top ends of which are shown and the supports are spanned by a deck structure 8 formed in accordance with the invention as will be explained in more detail later. The deck structure includes a series of passages 10,12,14 which connect a shielded area (not shown) at the leading edge of the deck structure in which excavation works take place, to the surrounding environment. The passages allow the return of excavated materials to be discarded, access for persons and the passages of utilities.

The deck structure in this embodiment is to be installed under existing facilities, in this case a rail track. The structure supports an upper surface 16 of the bridge which includes ballast, sub ballast and, in this case as the bridge which is formed is to support an existing track, a rail track 18 support system.

Figure 2:
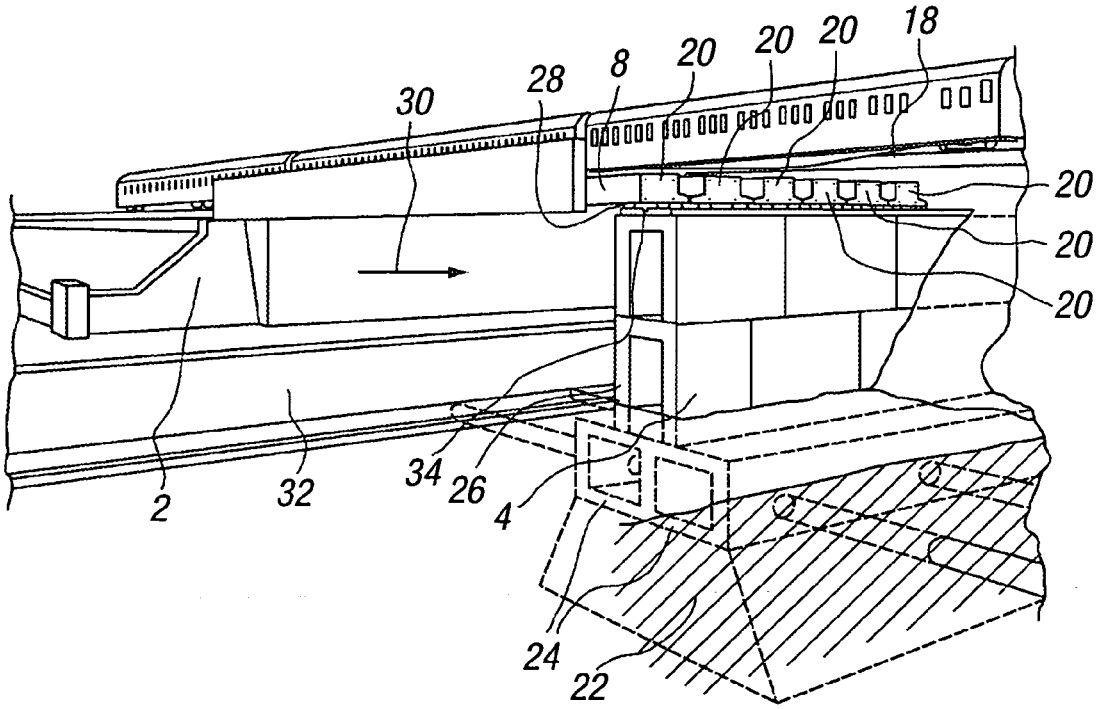
FIG. 2 illustrates a perspective view of part of a further load bearing construction formed in accordance with the invention.

FIG. 2 illustrates a perspective view of another bridge structure formed in accordance with the invention and the same reference numerals are used for the same features for ease of reference. In this case a rail track is supported by the deck structure 8 formed from a series of precast beam units 20 supported between the bridge supports 2,4.

Although shown and herein described with the formation of the decking structure utilising a series of precast beams the decking structure can be formed from a large precast slab construction which typically would be constructed on a launch pad adjacent to the bridge.

An example of the method used to allow the formation of the bridge and decking structure is now provided with respect to the embodiment where the decking structure is formed from a series of precast beams and with reference to FIG. 2. The sequence for construction can be as follows:

1. Excavate launch pits at each of the three points sufficiently wide to set foundation boxes for the supports and provide reaction arrangements.
2. Using precast boxes with the leading one fitted with a cutting shield, commence the jacking installation excavating in the shield and add additional precast boxes as they are jacked through the pit
3. Once the foundation units are installed wall units are jacked on top of the boxes. These units ride in channels formed in the top of the foundation boxes. They are fitted with a cutting shield where excavation is undertaken.

4. If required a second wall unit can be placed on top of the first.
5. As the upper parts of the structures are jacked in falsework is installed in the pits to allow jacking at higher levels.
6. If required all three structures can be installed at the same time In this way the basic shell of the bridge supports is created. These units provide access for undertaking additional operations like stabilising or reinforcing soil below the boxes.

Once the support units are in position has been created it is then possible to undertake the operations necessary to turn them into a homogenous structure. This can be done by filling the units with concrete and stressing them together. In order to receive the jacked deck structure, in the upper section of the wall boxes a guide and bearing track 34 is constructed very precisely which will be the path along which the jacked deck will slide. The upper part of the supports are designed so that a section or lid can be removed to expose this track 34.

A launch area is provided and in this case a series of precast beams 20 are provided which are jacked in successively as indicated by the arrow 30 to form the decking structure which spans the bridge supports 2,4.

A steel shield (not shown) is formed at the leading edge of the decking structure where excavation is required to take place to form the cavities into which the decking structure is to be advanced. Access to the shield for workers and for soil removal, air and power supply is provided by a series of passages 10, 12, 14 in the decking structure as already described.

As required, known techniques can be used to provide friction reduction and avoid lateral movement of the facility. If the decking structure is provided relatively close to the top of the upper surface 16, conventional techniques can be used to transfer the upper surface load directly on to the deck structure as it is jacked forward.

Once the deck structure is in place as shown on the bridge supports 2, 4 in FIG. 2 then the removal of any further soil and any special measures needed can be undertaken without difficulty as the facility is fully supported. All other works such as installation of roadways, track formation, surface finishes can also be undertaken.

The present invention therefore provides significant advantages in comparison to conventional techniques. For example, in the embodiment shown in FIG. 2 where a new road 32 is to be located under the bridge which has caused the need for the bridge, the conventional approach would have been to cast at site a large underpass box of the length required. This is difficult and has large costs involved in providing a suitable launch area for the box. In the current invention no box is required as the decking structure is formed from the relatively slim, precast beams or a single, thin slab unit and hence the launch area and formation work required is significantly reduced.

The foundations and walls onto which the deck structure in accordance with the invention is moved and subsequently supported by can be installed in a number of ways, one of which has been described with reference to FIG. 2 and another useful method is now described with reference to FIG. 3.

Figure 3:
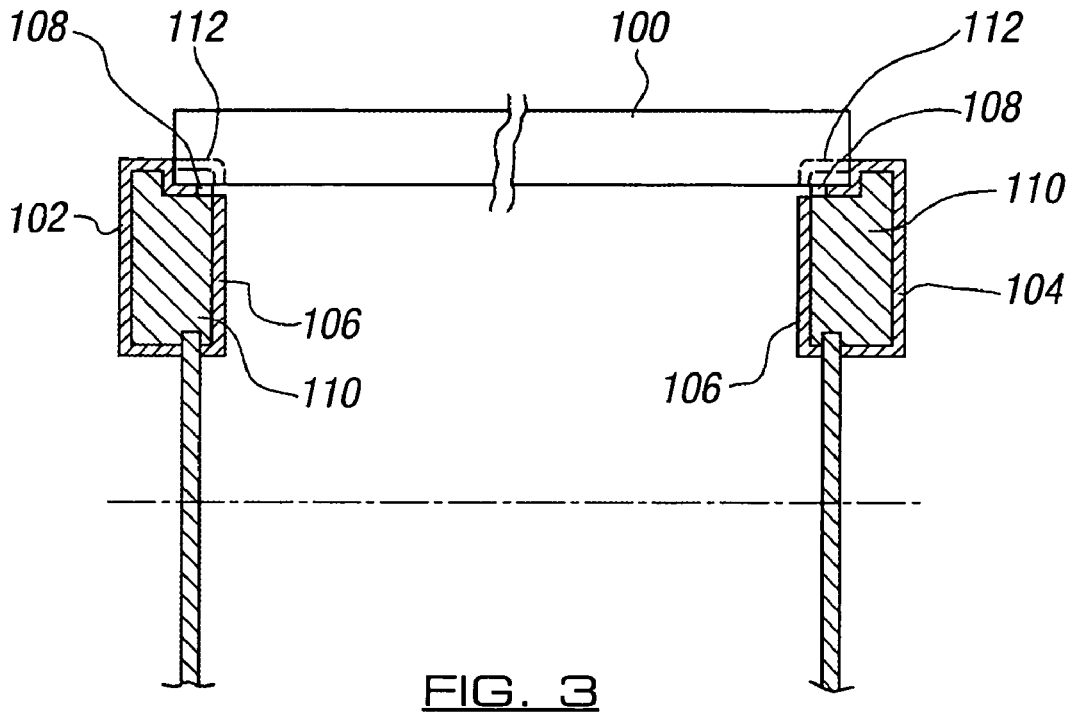
FIG. 3 illustrates an elevation of another form of supports and foundations which can be used to provide the supports for the deck structure in accordance with the invention.

In FIG. 3 there is shown a method of constructing the foundations and wall for the deck structure 100. In this case, to install the foundation and walls for use as an underpass structure, access box is 102, 104 are driven into position at each side of the structure. These boxes fulfil three functions in the following sequence. Firstly, the internal vertical wall 106 of each box provides part of the walls of the structure. Secondly, after having driven the boxes to a predetermined height suitable for the installation of the deck structure 100 as shown, the boxes provide access for a piling or diaphragm wall system from which the walls of the structure could be constructed. Thirdly, after the above work is completed, a bearing and track can be prepared in the internal upper part of the boxes to provide a slide path 108 as the deck structure 100 is installed by jacking. After preparation of the track 108 the space 110 below the track can be filled with concrete to provide a permanent founding and wall structure. The access box 102, 104 can be designed so that during jacking it will be possible to remove the upper corner right and left hand lids 112 respectively to expose the track slide paths 108.

Figure 4:
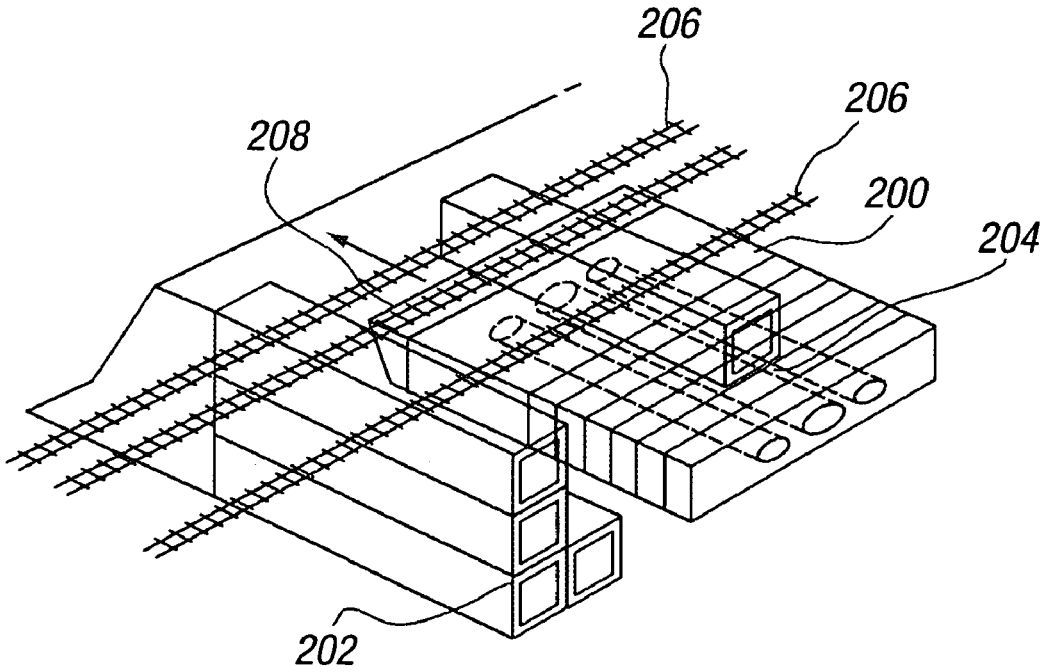
FIG. 4 illustrates a further embodiment of the invention.

FIG. 4 is an isometric view which illustrates the concept of jacking a deck structure 200 in the form of a series of beam units onto two previously installed supports 202, 204. It is possible to jack the deck structure immediately below the rail tracks 206 and the load of the track and trains is transferred directly onto the top of the structure and not through any soil cover. This is done by constructing a load spreading support grid (not shown) immediately below the track. This consists of structural sections constructed parallel to the track and cross connections across the width of the tracks. The longitudinal members parallel to the sleepers and at the same level, the cross members below the longitudinal members. All of these part can be installed in short possessions and with care taken to ensure the level is correct as the deck will be jacked to interface with this support system. In FIG. 4 the shield 208 at the leading edge of the deck structure is shown and, in this embodiment, as the deck advances, projecting "spiles" from the shield can be designed to make contact with the cross members of the support grid and pick up the track load in advance of the deck. This ensures that effective load transfer takes place. In order to ensure that no horizontal force is induced in the support system two methods can be used, these being either the use of industrial "skates" between the top of the box and the cross beams or the use of Teflon faces on the deck and cross beams with suitable lubricants. Once the deck structure is installed the rail tracks are completely carried directly by the deck.

Figure 5:
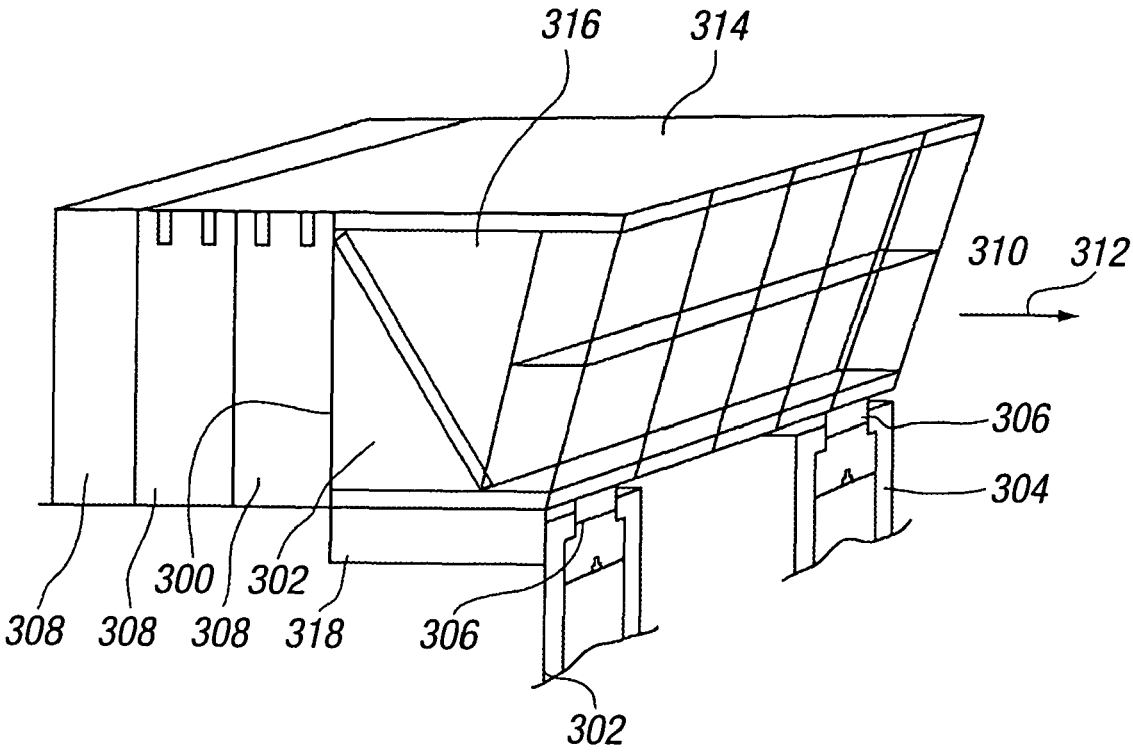
FIG. 5 illustrates a detailed view of a shield arrangement for the jacked deck structure.

In FIG. 5 there is shown the leading edge 302 of a deck structure 300 positioned to be introduced and moved along supports 302, 304 which are provided with tracks 306. The deck structure is formed from a series of beam units 308 which are advanced into the space 310 in direction 312 until in the desired position. The leading edge 302 has a shield 314 attached thereto and the shield allows protection for personnel in the area 316 who are excavating the space 312 in advance of the deck structure. If required side shields 318 can be provided to protect the tracks 306.

The use of a deck structure in accordance with the invention requires much less excavation and reduces face stability and settlement problems. The typical volume of excavation in the tunnelling operation for the bridge supports and decking structure is $\frac{1}{3}^{rd}$ of that of a conventional full equivalent box. Furthermore, the majority of the bulk excavation (⅔rds) and its removal can be undertaken with standard equipment economically and quickly. Furthermore as the face area exposed at any time is very limited this reduces greatly the risk of soil loss and settlement and avoids the large face stability and settlement issues that are found in excavating the full face of a conventional box as typically no face of the new decking structure is higher than 2 m This is a major advantage in difficult ground when compared to a typical jacked box height of 7-8 m. As a result, the size of the exposed face using the modular bridge support units and decking structure is very limited and this reduces the risk of collapse. Because units are precast the time on site can be greatly reduced and as the work can be performed from relatively small jacking pits for the bridge supports the decking structure can be prepared at a relatively high level so will require relatively little excavation for the launch area. The main bulk of excavation for the underpass can be done freely with conventional earth moving machinery (not in tunnelling) after the structure is in place supporting the existing facility.

The current invention also ensures that the line and level of the decking structure are controlled accurately.

Time savings can also be achieved as the bridge supports can be installed simultaneously so reducing the period of construction and the decking structure can be installed more rapidly than a box as the jacking forces required are much reduced which in turn reduces the reaction requirements that have to be installed.

This invention therefore allows the whole of the underground structure, foundations, walls and deck/roof to be installed without surface disruption. Typically the depth of a deck or a beam to span 10 meters or more will have a depth of 1.5 meters and upwards. This provides sufficient depth to install a temporary shield on the leading edge of the deck and for access to be provided for persons to manually excavate. Virtually any form of underground structure can be created by using differing configurations of modular units and jacked decks These can range from underpasses with spans of 10 m upwards and by use of more than one span and a central pier it is possible to create separate carriageways.

For large underground structures at depth, such as metro stations it is possible from relatively small access excavations to create a structural shell which allows the majority of the work to be undertaken inside it safely and without surface disruption. The spans are limited only by the practicalities of the deck design and can easily exceed 20 meters.

All of these features individually or in combination ensure that there is provided an installation method which provides a less disruptive method requiring no possessions or shut downs of any existing facilities such as road or rail tracks passing over the construction.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claims, including the full range of equivalency to which each element thereof is entitled.

What is claimed is:

1. The deck structure for use as part of a load bearing construction, said deck structure comprising:

one or more precast units, the units are capable of being slidingly advanced into a position, the deck structure spanning between a first and a second support; and the first and second supports having an upper part with tracks having removable lids formed therein, the first and second supports being located in a position, the first and second supports having an appropriate height to receive the deck structure.

2. The deck structure according to claim 1 wherein said deck structure has a leading edge having a shielded area within for excavation works to allow for advancement of the structure into an excavation space.

3. The deck structure according to claim 2 wherein said shielded area is in communication externally with the construction via one or more passages or voids in the deck structure.

4. The deck structure according to claim 2 wherein the shielded area is compartmentalizable to assist in controlling excavation works.

5. The deck structure according to claim 1 wherein the deck structure includes at least one access void.

6. The deck structure according to claim 1 wherein the first and second supports are combinable with a jacking apparatus for jacking foundation units, and thereafter wall units to a height appropriate for an underside of the deck structure.

7. The deck structure according to claim 1 wherein the deck structure comprises one slab unit pre-formable to appropriate dimensions prior to jacking onto the supports.

8. The deck structure according to claim 1 wherein the deck structure comprises a series of units successively advanceable by jacks onto the first and second supports.

9. The deck structure according to claim 1 wherein the deck structure is on a fixed or sliding bearing on the tracks on the first and second supports.

10. The deck structure according to claim 9 wherein the bearings are in the tracks on the first and second supports prior to installation of he deck structure.

11. The deck structure according to claim 10 wherein the tracks and bearings are revealable by removal of the lids from the first and second supports as the deck structure moves forward.

12. The deck structure according to claim 1 wherein said desk structure supports a road or rail track facility.

13. A load bearing construction, said construction comprising:

foundation units and wall units;

at least a first and a second support being formed from the foundation and wall units and having upper parts with tracks formed therein, the tracks being covered with removable lids for exposing and covering the tracks;

one or more slab or beam units; and a decking structure formed from the one or more slab or beam units and being located on the tracks, the decking structure being advanceable into a position on the first and second supports from a location adjacent construction and spanning the at least first and second supports.

14. The construction according to claim 13 wherein said deck structure supports a rail or road facility.

15. The construction according to claim 14 wherein the deck structure is installable while the road or rail facility is above a space in which the deck structure is advanceable, and shape and/or appearance of the road or rail facility does not change during the installation of the deck structure.

16. A deck structure, said structure comprising:

at least two support structures, each support structure having an upper end with a track covered by a removable lid formed in the upper part, the deck structure being located on the at least two support structures;

one or more beams supported by the at least two support structures to form a load bearing deck structure, the one or more beams spanning between said at least two support structures and being capable of being moved into a position by horizontal jacking; and the deck structure being moveable into the position along the uncovered tracks formed in the at least two support structures.

* * * * *